US008191970B2

(12) United States Patent
Igarashi et al.

(10) Patent No.: US 8,191,970 B2
(45) Date of Patent: Jun. 5, 2012

(54) BACKREST DEVICE IN A CHAIR

(75) Inventors: Ryo Igarashi, Tokyo (JP); Hiroaki Tsukiji, Yokosuka (JP); Hiroshi Masunaga, Yokohama (JP)

(73) Assignee: Okamura Corporation (JP)

( * ) Notice: Subject to any disclaimer, the term of this patent is extended or adjusted under 35 U.S.C. 154(b) by 128 days.

(21) Appl. No.: 12/092,290

(22) PCT Filed: Nov. 2, 2006

(86) PCT No.: PCT/JP2006/321942
§ 371 (c)(1),
(2), (4) Date: Jun. 3, 2008

(87) PCT Pub. No.: WO2007/052734
PCT Pub. Date: May 10, 2007

(65) Prior Publication Data

US 2009/0127914 A1 May 21, 2009

(30) Foreign Application Priority Data

| | | |
|---|---|---|
| Nov. 4, 2005 | (JP) | 2005-320759 |
| Nov. 4, 2005 | (JP) | 2005-320760 |
| Nov. 4, 2005 | (JP) | 2005-320761 |
| Nov. 4, 2005 | (JP) | 2005-320762 |
| Nov. 25, 2005 | (JP) | 2005-340235 |

(51) Int. Cl.
*A47C 7/40* (2006.01)
*A47C 7/02* (2006.01)

(52) U.S. Cl. ..... 297/452.15; 297/452.31; 297/452.46

(58) Field of Classification Search ..... 297/452.15, 297/452.18, 452.46, 452.31, 452.33, 452.36
See application file for complete search history.

(56) References Cited

U.S. PATENT DOCUMENTS

| | | | | |
|---|---|---|---|---|
| 219,589 | A * | 9/1879 | Mayo | 297/452.15 |
| RE25,710 | E * | 1/1965 | Ouellette | 297/452.15 |
| 4,368,917 | A * | 1/1983 | Urai | 297/452.54 |
| 4,913,493 | A * | 4/1990 | Heidmann | 297/285 |

(Continued)

FOREIGN PATENT DOCUMENTS

| | | |
|---|---|---|
| CA | 2 626 409 | 8/2003 |

(Continued)

OTHER PUBLICATIONS

International Search Report dated Jan. 23, 2007 issued in corresponding PCT Application No. PCT/JP2006/321942.

(Continued)

*Primary Examiner* — David Dunn
*Assistant Examiner* — Tania Abraham
(74) *Attorney, Agent, or Firm* — Ostrolenk Faber LLP

(57) ABSTRACT

A backrest device for a chair, in which a backboard is easily flexible without a reduction in its strength, thus making the chair comfortable to sit on. The lower ends of both right and left sides of the back frame are supported at both sides at the back of a leg body, and the flexible back board is formed on the inside of rear frames. A large number of openings are formed in the backboard so as to be close to each other in the top-bottom and left-right directions. Between openings adjacent to each other in the left-right direction, there is formed a connection section continuing in the top-bottom direction, and the dimension in the front-back direction of the connection section is made larger than the dimension in the left-right direction of the connection section.

8 Claims, 12 Drawing Sheets

U.S. PATENT DOCUMENTS

| | | | | |
|---|---|---|---|---|
| 4,962,964 | A * | 10/1990 | Snodgrass | 297/452.15 |
| 4,981,326 | A * | 1/1991 | Heidmann | 297/300.5 |
| 5,765,804 | A | 6/1998 | Stumpf et al. | |
| 5,810,438 | A * | 9/1998 | Newhouse | 297/286 |
| 5,934,758 | A * | 8/1999 | Ritch et al. | 297/452.54 |
| 6,626,497 | B2 * | 9/2003 | Nagamitsu et al. | 297/452.15 |
| 6,669,301 | B1 * | 12/2003 | Funk et al. | 297/452.63 |
| 6,811,215 | B2 | 11/2004 | Horiki et al. | |
| 6,908,159 | B2 * | 6/2005 | Prince et al. | 297/452.23 |
| 6,913,315 | B2 * | 7/2005 | Ball et al. | 297/284.7 |
| 7,249,802 | B2 * | 7/2007 | Schmitz et al. | 297/452.31 |
| 7,320,503 | B2 * | 1/2008 | Eysing | 297/452.63 |
| 7,441,758 | B2 * | 10/2008 | Coffield et al. | 267/142 |
| 7,455,365 | B2 * | 11/2008 | Caruso et al. | 297/452.46 |

FOREIGN PATENT DOCUMENTS

| | | | |
|---|---|---|---|
| JP | 6-189838 | A | 7/1994 |
| JP | 8-507935 | | 8/1996 |
| JP | 11-348628 | A | 12/1999 |
| JP | 2000-270962 | A | 10/2000 |
| JP | 2002-125797 | A | 5/2002 |
| JP | 2005-160558 | A | 6/2005 |

OTHER PUBLICATIONS

Office Action dated Jan. 20, 2012 issued in corresponding Canadian Patent Application No. 2,628,209 (Total 2 pages).

* cited by examiner

BACKREST DEVICE IN A CHAIR

CROSS REFERENCE TO RELATED APPLICATIONS

The present application is a 35 U.S.C. §§371 national phase conversion of PCT/JP2006/321942, filed 2 Nov. 2006, which claims priority of Japanese Application No. 2005-320759, filed 4 Nov. 2005, Japanese Application No. 2005-320760, filed 4 Nov. 2005, Japanese Application No. 2005-320761, filed 4 Nov. 2005, Japanese Application No. 2005-320762, filed 4 Nov. 2005, and Japanese Application No. 2005-340235, filed 25 Nov. 2005. The PCT International Application was published in the Japanese language.

BACKGROUND OF THE INVENTION

The present invention relates to a backrest device in a chair and particularly relates to a backrest device in a chair comprising a flexible back plate for supporting the back of an occupant in a back frame supported by a leg.

Such a backrest device in a chair is known from JP2002-125797A and JP2005-160558A.

The backrest device in the publications disclose that a back frame and a back plate have nearly uniform thickness to make it impossible for an upper part of the back plate onto which the back of an occupant strongly presses to be bent rearward effectively. So the chair would not be comfortable to sit on.

In order to allow the back of the occupant to fit over the backrest, the whole back plate may preferably be bent to be convex. But it would be very hard to bend a uniform-thickness back plate only by forming a number of opening in the back plate.

A number of openings close to each other in the back plate would decrease bending rigidity or strength of the back plate to reduce durability.

In order that side back frames may firmly be mounted to back rods fixed to legs and that the back plate pressed by the back of the occupant in the back frame may effectively be bent rearward to get more comfortable to sit in, JP2002-125797A discloses a backrest device with side back frames having a relatively large circular cross-section to provide higher bending rigidity.

In contrast to the thinner back plate, the thicker back frame provides poor appearance.

JP2005-160558A discloses that the side back frames in FIG. 10 have a circular cross-section for improving bending rigidity, but causes poor appearance. The back frame in FIG. 12 has a flat cross section and provides lower bending rigidity. When the inner back plate is pressed rearward, the back frame is bent rearward together. So the back plate would be unlikely to bend rearward.

SUMMARY OF THE INVENTION

In view of the foregoing disadvantages, it is an object of the invention to provide a backrest device in a chair in which the back of an occupant is suitably supported by a back plate so that the chair is more comfortable to sit on.

DETAILED DESCRIPTION OF PREFERRED EMBODIMENTS

Figure 1:
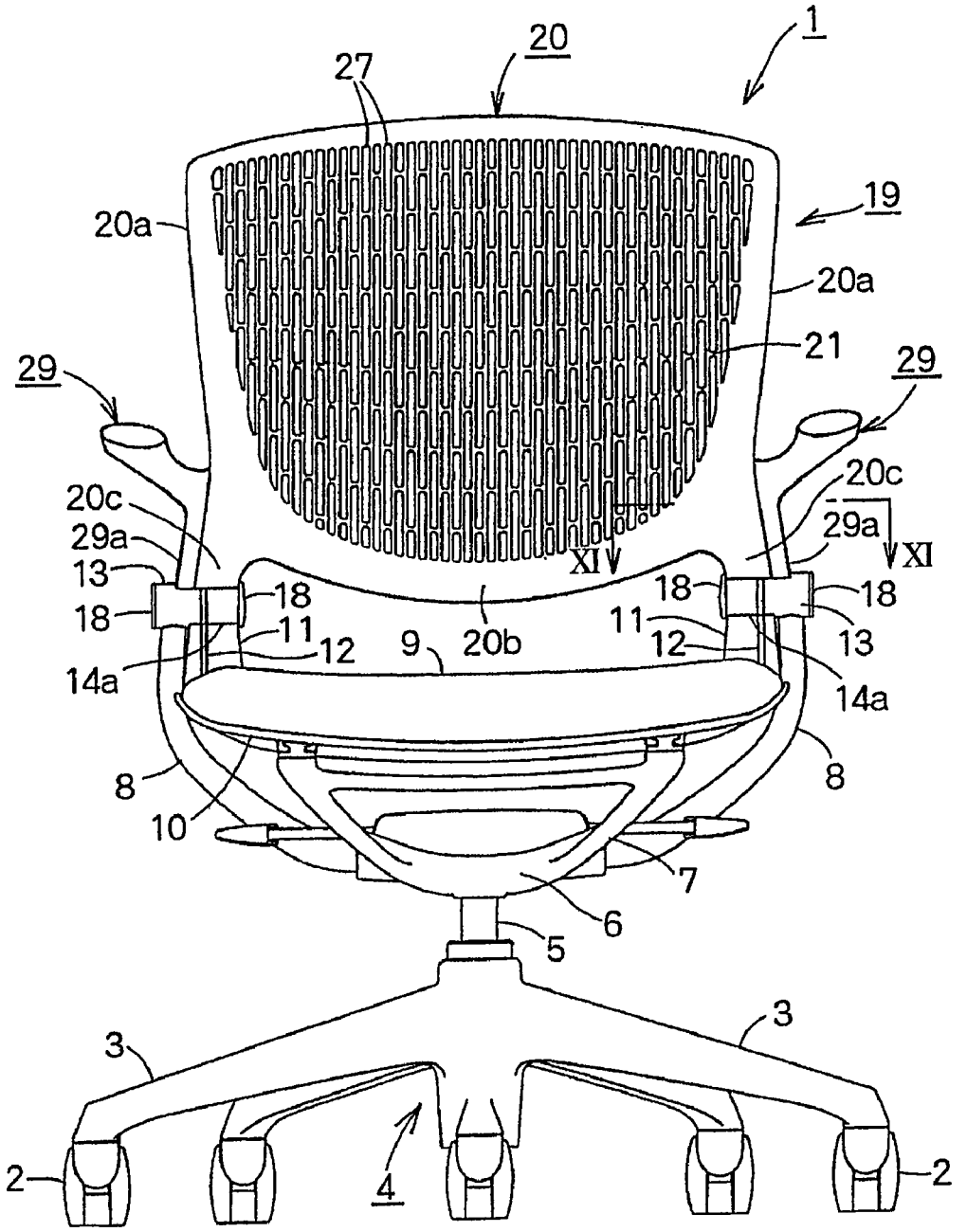
FIG. 1 is a front elevational view of an embodiment of a chair according to the present invention.

A chair 1 comprises a lower part 4 which consists of five legs 3 each of which has a caster 2 at the end; a post 5 which is retractable in the lower part 4 by a gas spring (not shown); and a support base 6 fixed to the upper end of the post 5.

Figure 5:
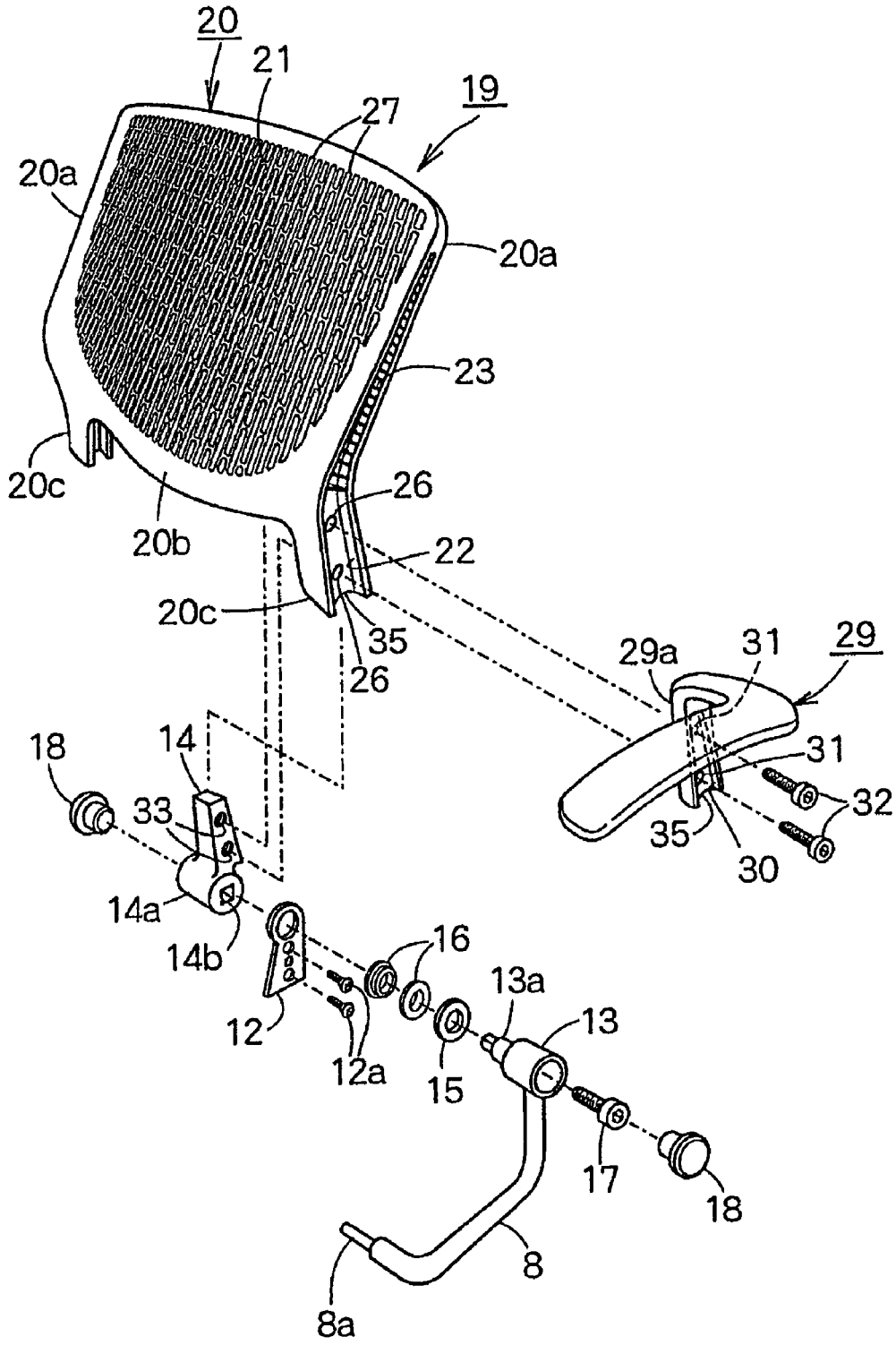
FIG. 5 is an exploded perspective view of a mounting portion of the backrest and armrest.

A seat support frame 7 is integrally formed with and extends upward from the front end of the support base 6. A pair of backrest support rods 8,8 extends from the support base 6. In FIG. 5, a shaft 8*a* of each of the support rods 8,8 extends through a rubber torsion unit (not shown) in the support base 6 such that the support rods 8,8 are urged forward pivotally to move back and forth.

A cushion 9 is stretched over the upper surface of a seat 10. The seat 10 is supported by the seat support frame 7 to move back and forth. Each side of the rear end of the seat 10 is pivotally mounted to the upper end of the backrest support rod 8. Specifically, a pair of support portions 11,11 is provided at the upper ends of the rear ends of the seat 10. A pair of seat support brackets 12 is fixed to the sides of the support portions 11,11. In FIG. 5, a rectangular shaft 13*a* projects from an axial support portion 13 fixed to the upper end of the backrest support rod 8. The rectangular shaft 13*a* engages in the upper part of each of a pair of seat-support brackets 12,12 each of which is fixed with a head screw 12*a* to the side of the support portion 11, so that the seat 10 is supported by the upper ends of the backrest support rods 8,8 to allow the seat 10 to tilt rearward.

With a washer 15 and two bushings 16,15, the rectangular shaft 13*a* engages in a rectangular hole 14*b* of an axial portion 14*a* at the lower part of a back-frame-mounting rod 14 for supporting the backrest 19. A bolt 17 passes through the axial support portion 13, the rectangular shaft 13*a* and the seat support bracket 12, and engages in an internal thread (not shown) in the axial portion 14*a*.

Caps 18,18 cover the axial support portion 13 and an axial portion 14*a* of the back-frame mounting rod 14. So the bolt 17 is not seen from outside.

The backrest 19 comprises a rectangular back frame 20 and a back plate 21, and is molded from synthetic resin.

Figure 4:
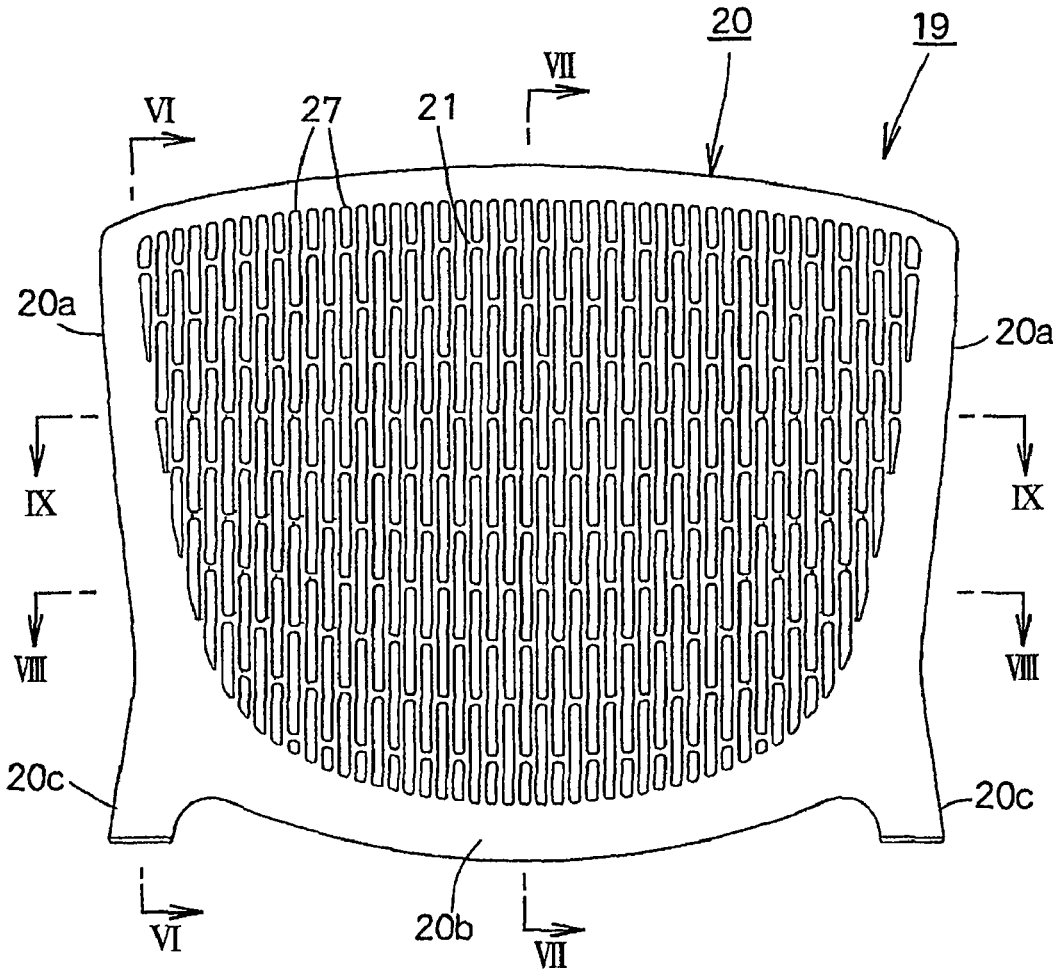
FIG. 4 is a front elevational view of the backrest.

In FIG. 4, at the lower ends, side portions 20*a*,20*a* of the back frame 20 have mounting portions 20*c*,20*c* which are slightly bent outward and attached to the support rods 8,8.

Figure 2:
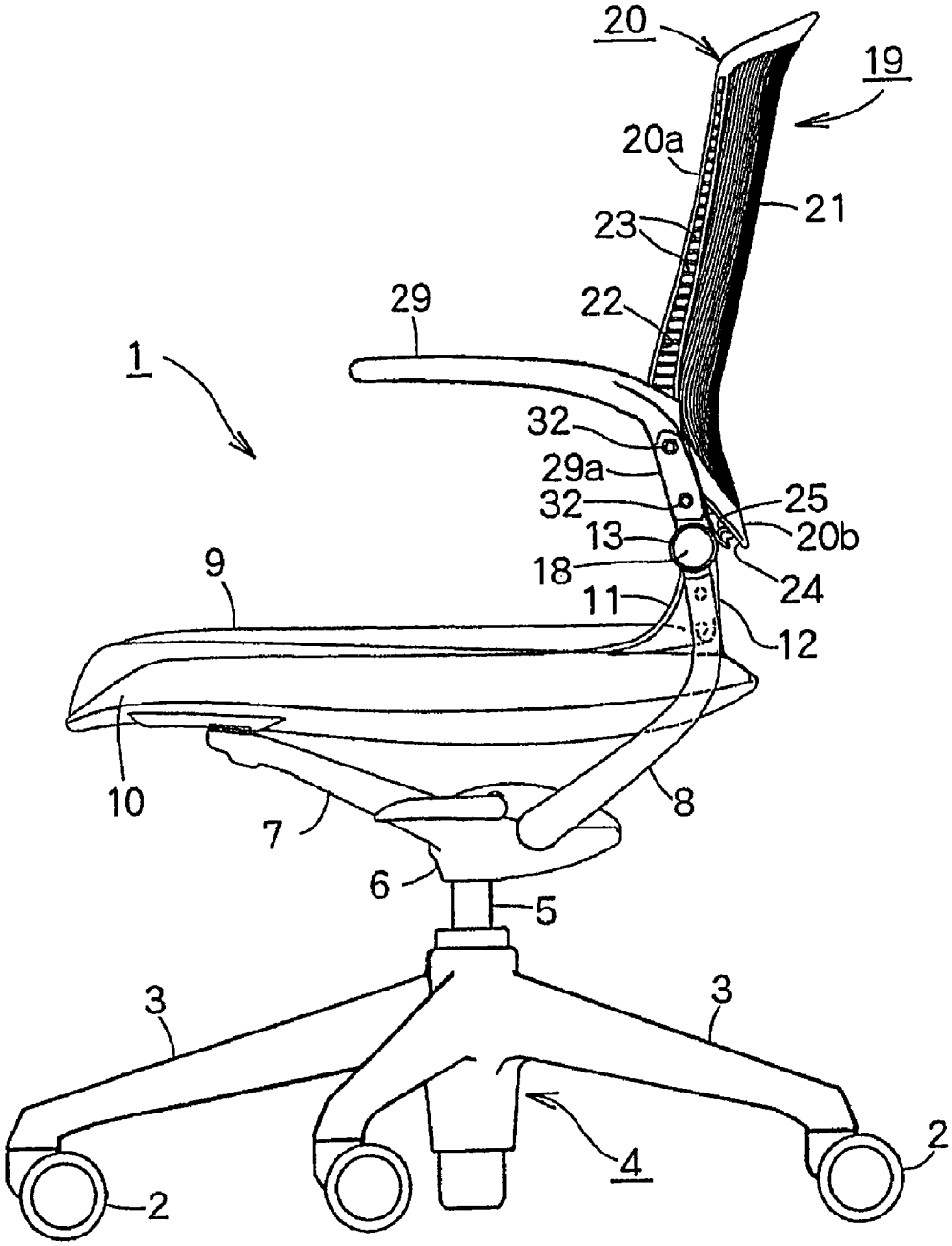
FIG. 2 is a side elevational view thereof.
Figure 3:
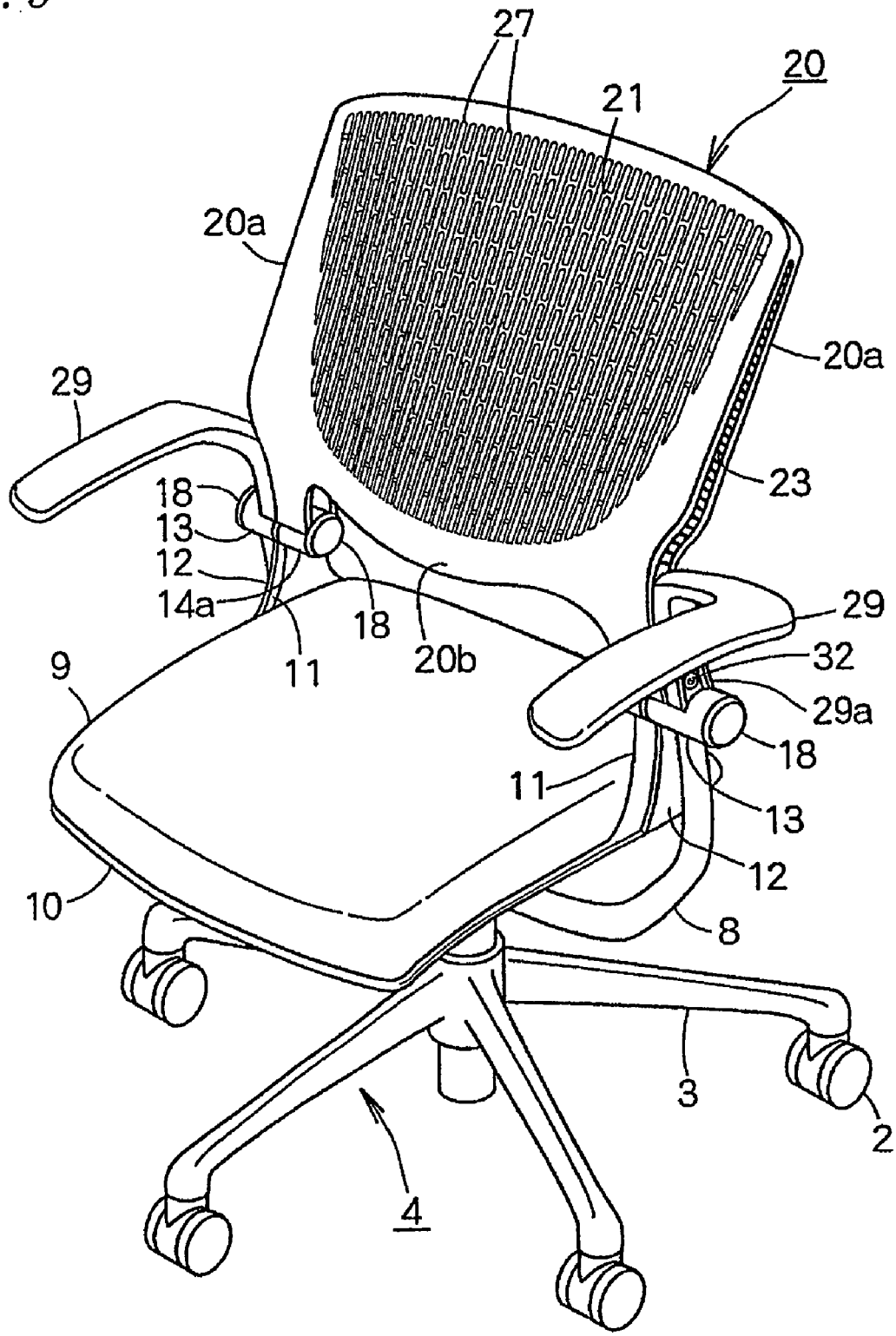
FIG. 3 is a front perspective view thereof.
Figure 6:
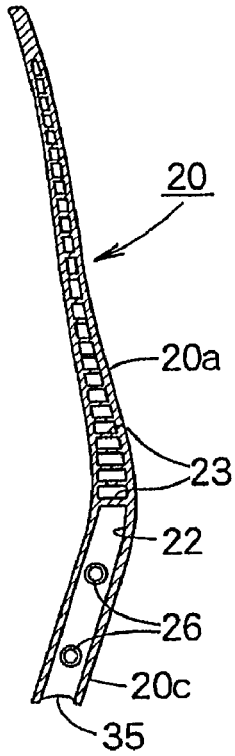
FIG. 6 is an enlarged vertical sectional side view taken along the line VI-VI in FIG. 4.

The side portion 20*a* is integrally formed with the back plate 21. In FIGS. 2 and 6, the side portion 20*a* gradually decreases in thickness upward from the lower end. The backrest 19 has a groove 22 at each side end in FIGS. 8 and 9.

A plurality of ribs 23 extend in the groove 22 in a nearly horizontal direction at regular intervals to improve bending rigidity of the side portion 20*a*.

Figure 7:
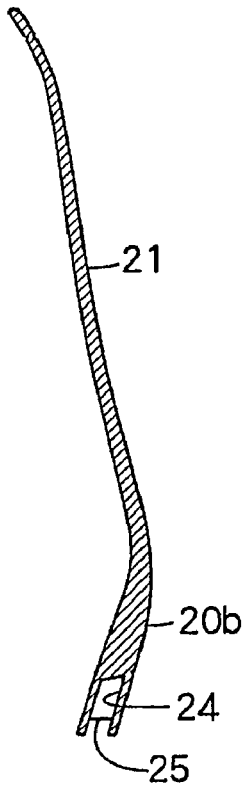
FIG. 7 is an enlarged vertical sectional side view taken along the line VII-VII in FIG. 4.

A lower portion 20*b* of the back frame 20 is curved and its cross section is an inverted U shape in FIG. 7, and a plurality of ribs 25 extend in a nearly vertical direction in a groove 24 at the lower end of the lower portion 20*b* to improve bending rigidity of the lower portion 20*b*.

In FIG. 5, two stepped bores 26,26 are formed in the bottom of the groove 22 at the lower end of the side portion 20*a* to allow a bolt for mounting an armrest 29 to engage therein.

Figure 8:
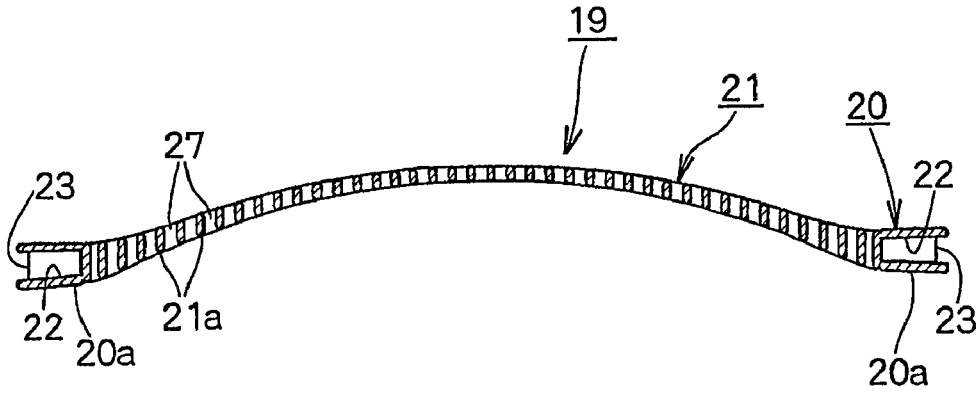
FIG. 8 is an enlarged horizontal sectional plan view taken along the line VIII-VIII in FIG. 4.

In FIG. 7, the back plate 21 becomes thinner gradually upward from the lower end as well as the side portion 20*a*. In FIG. 8, the back plate 21 becomes thinner gradually toward the middle from the side ends.

In the whole surface of the back plate 21, a plurality of slits 27 are equally spaced vertically and horizontally. The horizontally adjacent slits 27 are staggered by half a length of the slit 27.

Figure 10:
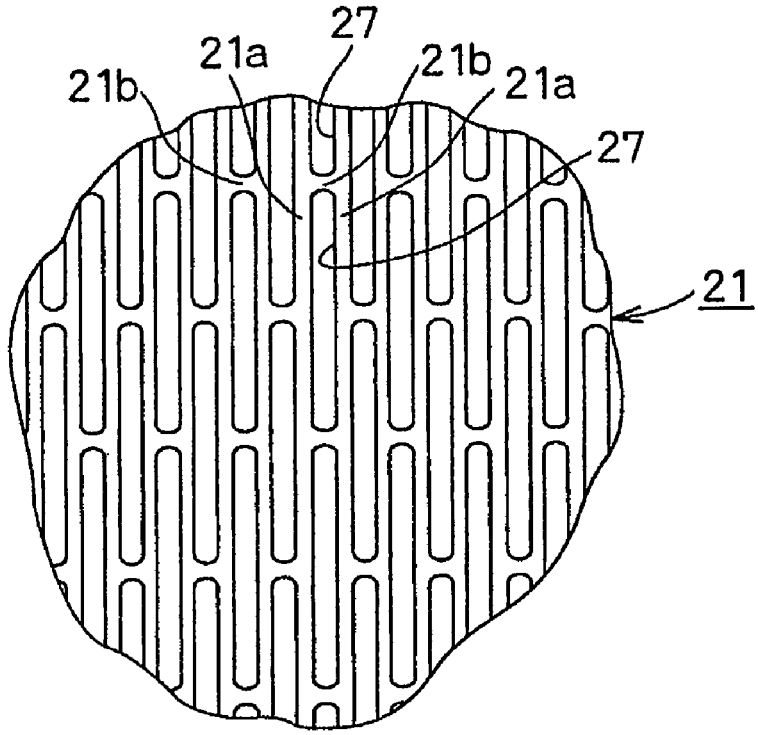
FIG. 10 is an enlarged front view of the part of a back plate.

In FIG. 10, a distance of a vertical portion 21*a* provided between the horizontally adjacent slits 27 along a thickness of the back plate is larger than a distance of the vertical portion 21*a* along the width of the backrest 19 in FIG. 8.

Figure 9:
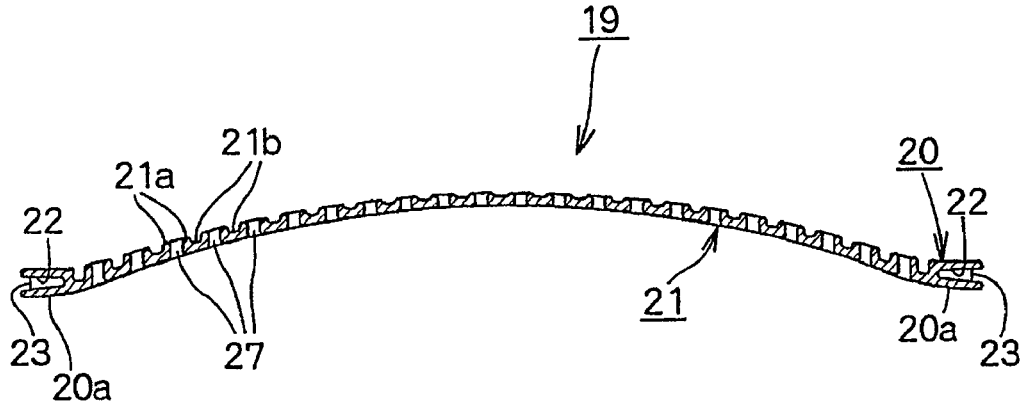
FIG. 9 is an enlarged horizontal sectional plan view taken along the line IX-IX in FIG. 4.

In FIG. 9, a distance of a horizontal portion 21*b* provided between the vertically adjacent slits 27 along the thickness of the back plate is smaller than the distance of the vertical portion 21*a* along the thickness of the back plate. The horizontal portion 21*b* has a U-like cross section in the rear surface.

When the back plates 21 are pressed rearward, the U-like rear surfaces of the horizontal portions 21*b* are stretched out to allow the whole back plate 21 to bend rearward with respect to the slits 27 easily, but unlikely to bend rearward with respect to the horizontally adjacent slits 27.

The vertical portion 21*a* between the adjacent slits 27 has a rectangular horizontal cross-section in which a distance along a thickness of the back plate 21 is larger than a distance along a width of the back plate 21, preventing the back plate 21 from decreasing in strength.

Figure 11:
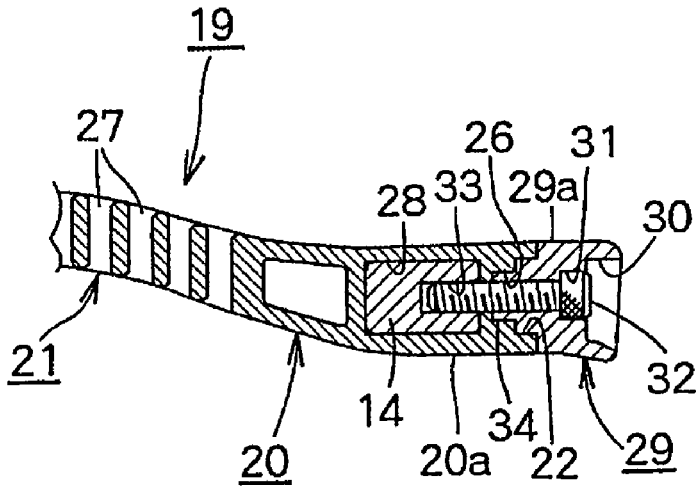
FIG. 11 is an enlarged horizontal sectional plan view taken along the line XI-XI in FIG. 1.

In FIG. 11, at the lower end of the side portion 20*a* of the back frame 20, a rectangular hole 28 vertically extends and engages with the rectangular back-frame mounting rod 14 of the backrest support rod 8. The rod 14 is fixed together with the armrest 29 to the side portion 20*a* as below.

In FIG. 5, a mounting portion 29*a* of the armrest 29 fits in the groove 22 of the side portion 20*a*. Bolts 32,32 passes through stepped bores 31,31 in a bottom of a groove 29 of the mounting portion 29*a* and through the stepped bores 33,33 of the back-frame mounting rod 14 fitted in the groove 28 of the side portion 20*a*. The bolts 32,32 engages in the stepped bores 26.

Thus, the back frame mounting rod 14 of the backrest support rod 8, the side portion 20*a* of the back frame 20 and the armrest 28 are fastened with the two bolts 32 firmly. Especially, the mounting portion 29*a* of the armrest 29 fits in the groove 22 of the side portion 20*a* and is fixed therein, thereby preventing the back frame from loosening.

In FIG. 11, a projection 34 is provided on the mounting portion 29*a* of the armrest 29 to engage with an outer larger-diameter part of the stepped hole 26 of the side portion 20*a* thereby facilitating positioning to the side portion 20*a*.

At the lower end of the side portion 20*a* of the mounting portion 29*a*, a convex portion 35 engages with the upper surface of the axial support portion 13 and with the upper surface of the axial portion 14*a* to prevent loosening and to provide better appearance when the backrest 19 and armrest 29 are mounted to the backrest support rod 8.

In FIG. 11, the head of the bolt 32 is disposed on the larger-diameter portion of the stepped bore 31 within a groove 30 of the mounting portion 29*a*, and is not exposed outside.

As described above, in the embodiments, the back frame 20 of the backrest 19 is integrally formed with the back plate 21 as a relatively thin plate providing better appearance.

The side portion 20*a* and lower portion 20*b* of the back frame 20 are curved, and the grooves 22,24 in the side ends and lower end are coupled with the flat ribs 23,25 respectively. Thus, bending rigidity is high in spite of the plate-like back frame 20 to allow only the back plate 21 to bend rearward, improving sitting comfort when the backrest is pressed rearward by an occupant.

Furthermore, the side portions 20*a* and back plate 21 becomes thinner upward gradually. Even when the backrest 19 is strongly pressed, the upper part of the back frame 20 can suitably be bent and the upper part of the back plate 21 is likely to be bent rearward, providing more comfortable support for the upper part of the back of the occupant. The back plate 21 gets gradually thinner toward the middle from the side ends. So bending rigidity is lower in the middle pressed by the back of the occupant most strongly to allow the middle of the back plate 21 to bend significantly rearward, providing better comfort not only in the middle of the back but also all over the back of the occupant.

A number of slits 27 are formed in the surface of the back plate 21 and the middles of the horizontal portions 21*b* between the upper and lower slits 27 are thinner to allow them to be stretched out easily. Accordingly, the whole back plate 21 can be bent rearward with the slits 27 providing complete fitting all over the back of the occupant and making the chair more comfortable to sit on.

In the vertical portions 21*a* between the adjacent slits 27, the distance along the thickness of the back plate 21 is larger than the distance along the width thereof, so that the back plate 21 has higher bending rigidity along the thickness of the back plate 21. The back plate 21 provides sufficient strength in spite of a lot of slits 27.

Figure 12:
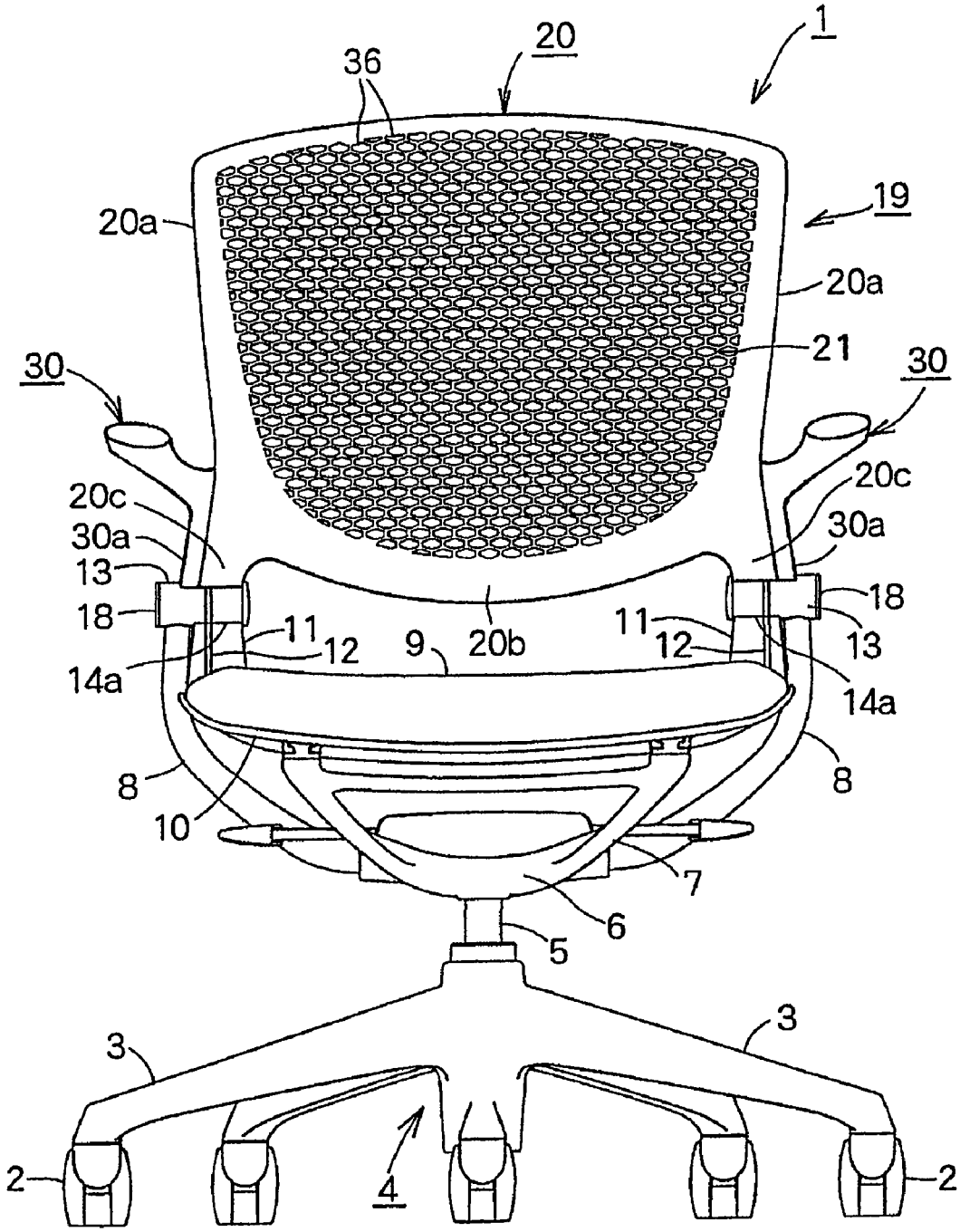
FIG. 12 is a front elevational view of another embodiment of a chair according to the present invention.
Figure 13:
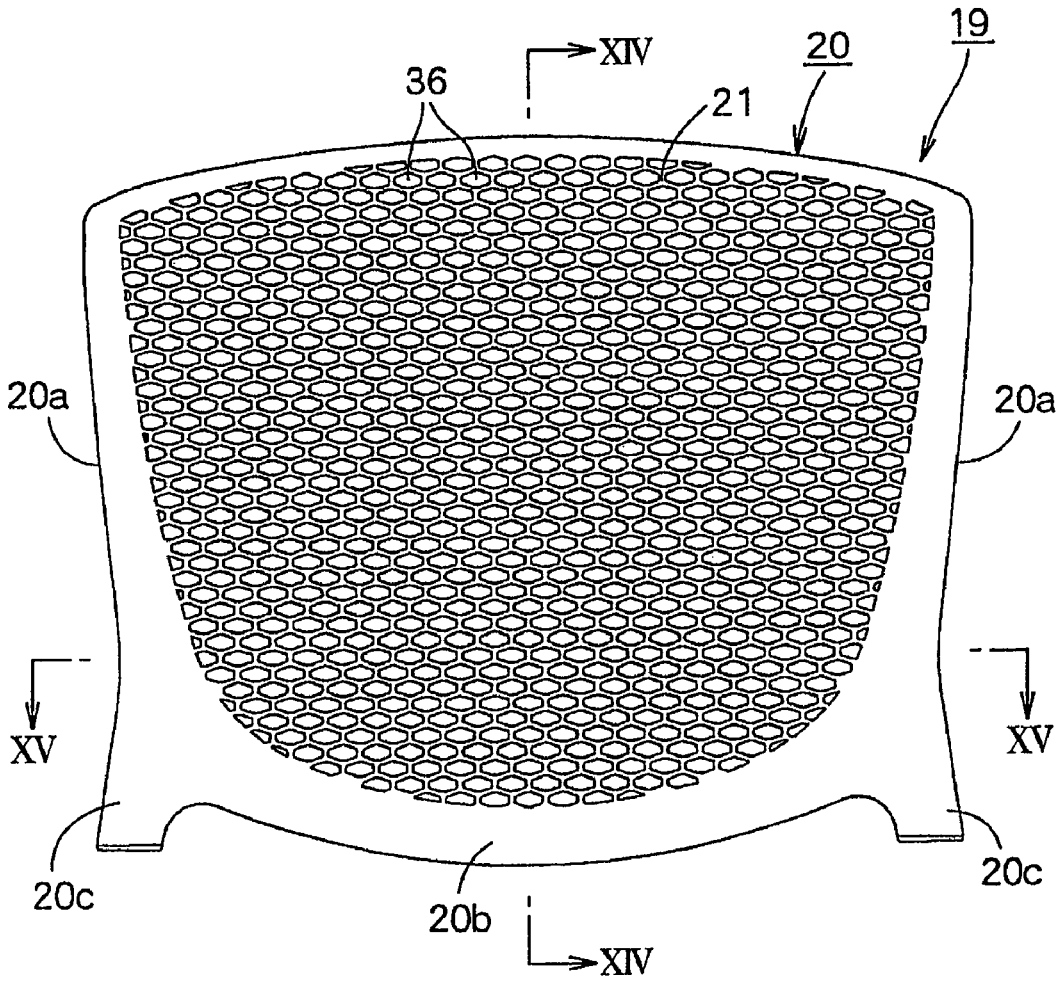
FIG. 13 is an enlarged front view of the backrest thereof.

FIG. 12 is a front elevational view of another embodiment of a chair according to the present invention, and FIG. 13 is a front elevational view of the backrest. In the embodiment, only a back plate 21 is different from the foregoing embodiments. The rest is the same and the same numerals are allotted to the same members and will be omitted in description.

Figure 14:
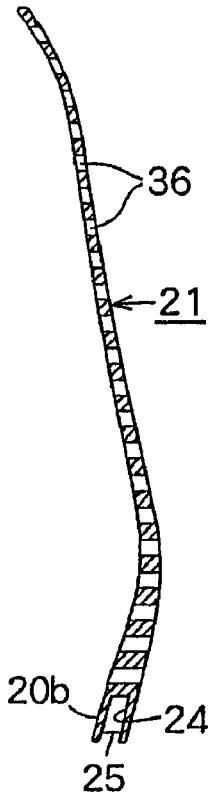
FIG. 14 is an enlarged vertical sectional side view taken along the line XIV-XIV in FIG. 13.
Figure 15:
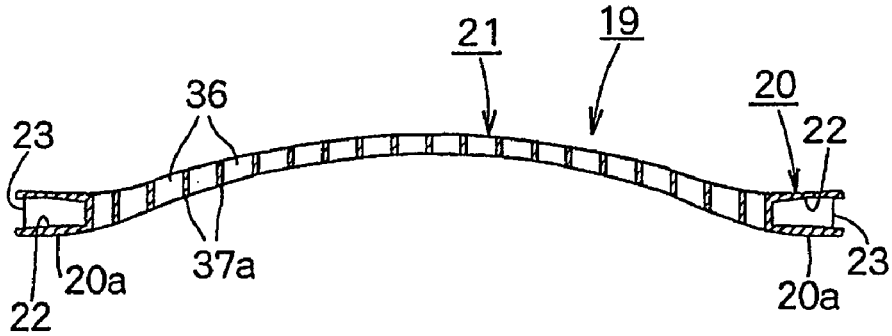
FIG. 15 is an enlarged horizontal sectional plan view taken along the line XV-XV in FIG. 13.

Like the foregoing embodiment, the back plate 21 becomes gradually thinner upward from the lower end and toward the middle from the side ends in FIGS. 14 and 15.

Hexagonal openings 36 are staggered all over the surface and arranged like a letter X on the back plate 21.

Figure 16:
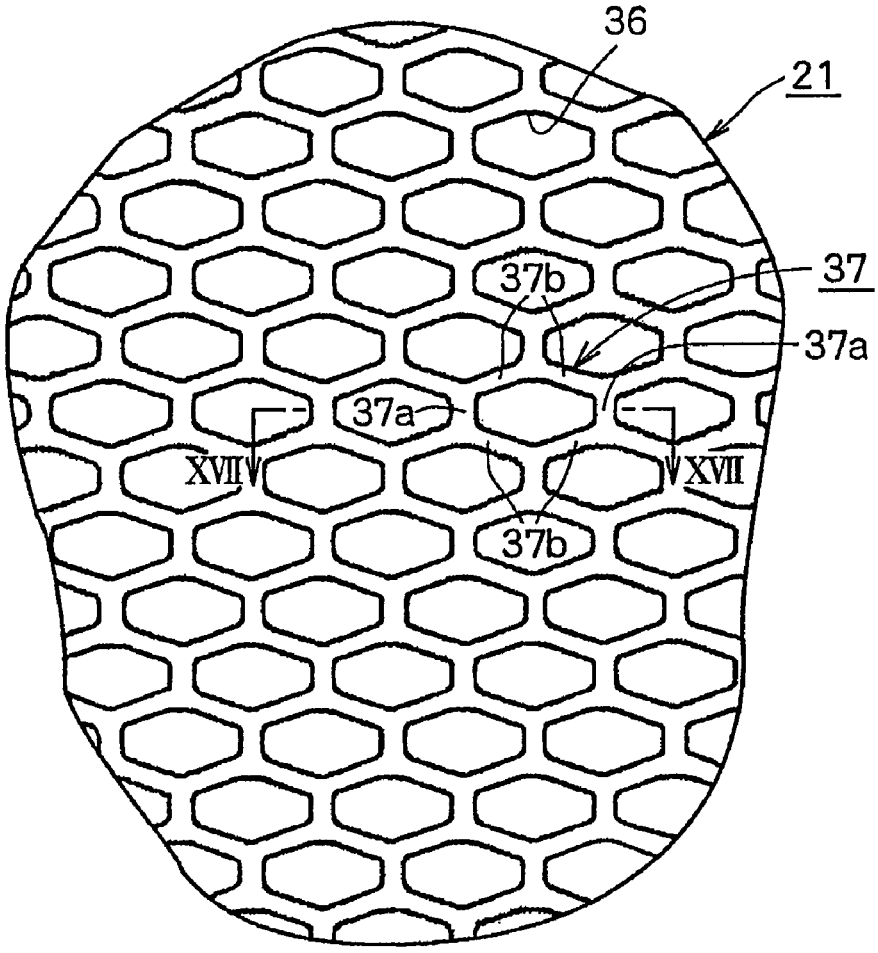
FIG. 16 is an enlarged front view of the part of a back plate.
Figure 17:
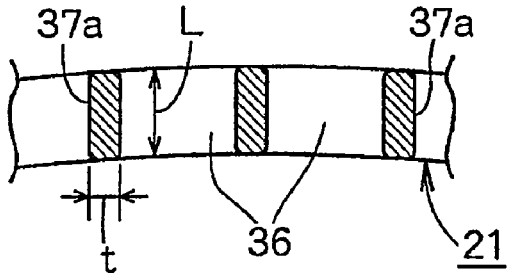
FIG. 17 is an enlarged horizontal sectional plan view taken along the line XVII-XVII in FIG. 16.

In FIG. 16, portions 37 which surround each of the openings 36 comprise vertical portions 37*a* between the horizontally adjacent openings 36 and slightly tilted lateral portions 37*b*. In FIG. 17, a distance L along a thickness of the back plate 21 is larger than a distance t along a width thereof.

Thus, when the back plate 21 is pressed by the back of an occupant, the whole back plate 21 is bent rearward with suitable bending resistance. The back plate 21 is likely to be bent with the hexagonal openings 36, but bending strength of the back plate 21 does not become lower.

The present invention is not limited to the foregoing embodiments.

The embodiment in FIGS. 1-11 discloses that the slits 27 in the back plate 21 are staggered. Alternatively, slits may be arranged along the same vertical lines. The lengths of slits may be variable.

The openings 36 of the back plate 21 in FIG. 12 may have other shapes such as a rhombus, an eclipse, and polygons other than a hexagon.

The present invention may apply to a chair in JP2002-125797A. To the upper ends of a pair of rear legs, backrest support rods are fixed. At the upper end of the support rod, the back frame mounting rod 14 in the embodiment may be mounted to the backrest 19 and armrest 29 with bolts.

The present invention may apply to a chair without an armrest. A shorter bolt 32 may pass through a stepped bore 26 of a side portion 20*a* and directly engage in a stepped bore 33 of a back frame mounting rod 14. If the shape of the upper end of the backrest support rod engages in a hole of the side portion, the lower end of the back frame can directly be mounted to the upper end of the backrest support rod.

What is claimed is:

1. A backrest device in a chair, the backrest device comprising:

a back frame including:

a flexible back plate having a front major surface, a back major surface and a thickness measured from the front major surface to the back major surface, a right lower end and a left lower end, each of the right and left lower ends being supported by a backrest support member; and the flexible back plate including:

a plurality of openings, one or more horizontal portions, each horizontal portion of the one or more horizontal portions positioned between a first opening of the plurality of openings and a second opening of the plurality of openings, the first opening adjacent the second opening in a vertical direction of the flexible back plate, the flexible back plate having a first thickness at each horizontal portion; and one or more vertical portions, each vertical portion positioned between the first opening and a third opening adjacent the first opening in a horizontal direction of the flexible back plate, the flexible back plate having a second thickness at the one or more vertical portions, wherein the first thickness is smaller than the second thickness.

2. The backrest device according to claim 1, wherein horizontally adjacent openings are staggered.

3. The backrest device according to claim 1, wherein each opening of the plurality of openings comprises a slit.

4. The backrest device according to claim 3, wherein horizontally adjacent openings are staggered.

5. The backrest device of claim 1, wherein the horizontal and vertical portions have a substantially U-shape.

6. The backrest device according to claim 5, wherein horizontally adjacent openings are staggered.

7. The backrest device according to claim 5, wherein each opening of the plurality of openings comprises a slit.

8. The backrest device according to claim 7, wherein horizontally adjacent openings are staggered.

* * * * *